US011136515B2

(12) United States Patent
Donegan

(10) Patent No.: US 11,136,515 B2
(45) Date of Patent: Oct. 5, 2021

(54) TEMPERATURE PROFILE IN AN ADVANCED THERMAL TREATMENT APPARATUS AND METHOD

(71) Applicant: STANDARD GAS LIMITED, London (GB)

(72) Inventor: Daniel Michael Donegan, Hatfield Peverel (GB)

( * ) Notice: Subject to any disclaimer, the term of this patent is extended or adjusted under 35 U.S.C. 154(b) by 50 days.

(21) Appl. No.: 16/680,295

(22) Filed: Nov. 11, 2019

(65) Prior Publication Data

US 2020/0080012 A1 Mar. 12, 2020

Related U.S. Application Data

(63) Continuation of application No. 15/554,628, filed as application No. PCT/GB2016/050583 on Mar. 4, 2016, now abandoned.

(30) Foreign Application Priority Data

Mar. 5, 2015 (GB) ..... 1503772

(51) Int. Cl.
*C10J 3/72* (2006.01)
*F23G 5/027* (2006.01)
(Continued)

(52) U.S. Cl.
CPC ..... *C10J 3/721* (2013.01); *C10B 1/10* (2013.01); *C10B 47/30* (2013.01); *C10J 3/005* (2013.01);
(Continued)

(58) Field of Classification Search
CPC .... C10J 3/721; C10J 2300/1223; C10J 3/005; C10J 2300/12; C10J 2300/1246;
(Continued)

(56) References Cited

U.S. PATENT DOCUMENTS 4,308,103 A 12/1981 Rotter
4,781,796 A 11/1988 Bridle
(Continued)

FOREIGN PATENT DOCUMENTS

DE 102012201743 B3 3/2013
EP 2783764 A1 10/2014
(Continued)

OTHER PUBLICATIONS

International Search Report and Written Opinion of the European Patent Office International Search Authority for International application No. PCT/GB2016/050583 dated Jun. 1, 2016.
(Continued)

*Primary Examiner* — Matthew J Merkling
(74) *Attorney, Agent, or Firm* — Procopio, Cory, Hargreaves & Savitch LLP

(57) ABSTRACT

Applying heat from a heat source to a first region to cause a first pyrolysis process, the first pyrolysis process resulting in a gaseous mixture, and applying heat from the heat source to a second region to cause a second pyrolysis process, the second pyrolysis process being applied to the gaseous mixture, wherein the second region is located closer to the heat source than the first region. Pyrolysis is used to destroy oils, tars and/or PAHs in carbonaceous material.

8 Claims, 8 Drawing Sheets

(51) Int. Cl.

| | |
|---|---|
| ***F23G 5/20*** | (2006.01) |
| ***C10J 3/00*** | (2006.01) |
| ***C10K 3/00*** | (2006.01) |
| ***C10B 1/10*** | (2006.01) |
| ***C10B 47/30*** | (2006.01) |

(52) U.S. Cl.
CPC ..... *C10K 3/001* (2013.01); *F23G 5/0273* (2013.01); *F23G 5/20* (2013.01); *C10J 2300/12* (2013.01); *C10J 2300/1223* (2013.01); *C10J 2300/1246* (2013.01); *C10J 2300/1253* (2013.01); *F23G 2203/20* (2013.01); *F23G 2209/22* (2013.01); *F23G 2209/26* (2013.01); *F23G 2209/28* (2013.01); *F23G 2900/50201* (2013.01)

(58) Field of Classification Search
CPC .... C10J 2300/1253; C10B 47/30; C10B 1/10; C10K 3/001; F23G 5/0273; F23G 5/20
See application file for complete search history.

(56) References Cited

U.S. PATENT DOCUMENTS

| | | | |
|---|---|---|---|
| 5,246,599 | A | 9/1993 | Aicher |
| 5,449,439 | A | 9/1995 | Heald |
| 5,720,232 | A | 7/1996 | Meador |
| 6,126,907 | A | 10/2000 | Wada |
| 7,883,605 | B2 | 2/2011 | Grispin |
| 8,882,966 | B2 | 11/2014 | Bronshtein |
| 2016/0039118 | A1 | 2/2016 | Gehr |

FOREIGN PATENT DOCUMENTS

| | | | |
|---|---|---|---|
| WO | 2001030943 | A1 | 5/2001 |
| WO | 2008136011 | A1 | 11/2008 |

OTHER PUBLICATIONS

UKIPO Search Report under Section 17(5) for UK application GB1503772.4 dated Apr. 1, 2016.
UKIPO Examination Report under Section 18(3) for UK application GB1503772.4 dated Oct. 18, 2016.
UKIPO Examination Report under Section 18(3) for UK application GB1503772.4 dated Feb. 15, 2017.
Office Action for related CN Patent Application No. 201680013967.0 dated Oct. 30, 2019, in 14 pages.
Office Action for related EP Patent Application No. 16712993.1 dated Nov. 14, 2019, in 4 pages.

TEMPERATURE PROFILE IN AN ADVANCED THERMAL TREATMENT APPARATUS AND METHOD

CROSS REFERENCE TO RELATED APPLICATIONS

This application is a continuation application of U.S. application Ser. No. 15/554,628, filed Aug. 30, 2017, which is a United States National Phase Application of PCT/GB2016/050583 filed Mar. 4, 2016, and claims priority to United Kingdom Patent Application No. 1503772.4 filed Mar. 5, 2015, all of which are incorporated by reference herein.

FIELD OF DISCLOSURE

The present invention generally relates to Advanced Thermal Treatment (ATT) methods and apparatuses. ATT is used to destroy calorific waste and to produce gas therefrom. The destruction of calorific waste is desirable to avoid the need for environmental damage due to burial in landfill sites, or dumping at sea. However, some forms of destruction create gaseous pollution and/or carbon dioxide, leading to environmental damage and potentially increasing global warming.

BACKGROUND

Advanced Thermal Treatment (ATT) primarily relates to technologies that employ pyrolysis or gasification. ATT is discussed in the Brief, entitled 'Advanced thermal treatment of municipal solid waste' produced by the Department for Environment, Food & Rural Affairs of the UK Government (https://www.gov.uk/government/publications/advanced-thermal-treatment-of-municipal-solid-waste). That Brief indicates a problem with conventional pyrolysis and gasification systems is tarring, in which the build up of tar can cause operational problems (for example, if tar build up causes blockages).

Pure pyrolysis is a process of thermochemical decomposition of material to produce gas, in which oxygen is absent. If a small quantity of oxygen is present, the production of gas is termed gasification. The amount of oxygen present in gasification is insufficient to allow combustion to occur. In the present application, unless otherwise specified, pyrolysis and gasification will have the same meaning.

In an ATT process, gas is released from a feed material or 'feedstock', leaving solid matter (char) as a by-product. The skilled person will understand that the term 'feedstock' as used throughout this description relates to any solid material having a calorific value. Feedstocks typically envisaged in this context are waste materials such as biomass, wood or paper, rubber tyres, plastics and polythene, or sewage solids. They also include low quality fossil fuels such as lignite or bituminous coals. The feedstock of ATT units for generating syngas may be most carbon-based materials with a calorific value. For example, fossil fuels can be used. However, in conventional ATT units, the feedstock must be prepared before entering the unit, thus adding additional time and expense to the process.

Conventionally, part of the preparation process includes drying the feedstock, as water may cool the ATT unit, thereby reducing the efficiency of the ATT process and increasing the amount of tars, oils and PAHs in the resulting gas. Moreover, in preparing the feedstock, certain material with a calorific value may be rejected as being non-compliant with a given ATT unit. For example, certain feedstock materials may be difficult for some fuel specific ATT technologies to breakdown using thermal processes.

The released gas, termed synthetic gas or "syngas" hereafter, can then be used as a fuel to generate heat or electricity either on the spot or elsewhere. If carbonaceous material is used as the feedstock, the resulting solid residue ("char") is generally richer in carbon. That char also may be used as a secondary fuel source. Generally, conventional pyrolysis processes do not result in syngas pure enough to be input into a generator. Instead, the syngas must first be put through a rigorous cleaning (scrubbed) process, so that any remaining particulate matter and tar are removed from the syngas. The retention of tar and oil is the consequence of insufficient temperature and dwell time.

Those oils and tars can contain polycyclic aromatic hydrocarbons, PAHs, (also termed poly-aromatic hydrocarbons), which are organic pollutants that may be formed from incomplete combustion of carbonaceous material (such as wood, coal, oil etc). PAHs can be hazardous to human health, and can have toxic and/or carcinogenic properties. It is therefore preferable that gas exiting the pyrolysis system is free from oils and tars, and therefore from PAHs.

PAHs usually have high melting points and boiling points. The boiling points may, for example, be 500° C. or more. For example, Picene ($C_{22}H_{14}$) has a boiling point of around 520° C. and a melting point of around 365° C. and Coronene ($C_{24}H_{12}$) has a boiling point of around 525° C. and a melting point of around 440° C. Accordingly, thermochemical decomposition, or 'cracking', PAHs requires very high temperatures and the PAHs are difficult to remove using a conventional pyrolysis process.

In some variants, a pyrolysis system includes a rotary retort in which the pyrolysis process takes place. The rotation of the retort helps to mechanically break up the feedstock. In order to provide adequate structural strength conventional rotary retorts may be made of materials such as steel or nickel alloy. Such materials are not particularly efficient thermal conductors, meaning that a large portion of the energy used to heat the rotary retort is not transferred to the feedstock and/or gas within the retort. It is difficult, therefore, to raise the temperature of inside of the retort to a level sufficient to fully crack the PAHs. The syngas exiting a conventional retort therefore contains particulate tars and oils, including the PAHs. Whilst the dwell time within the retort can be increased to crack the PAHs, this reduces the throughput of feedstock and therefore reduces the efficiency of the pyrolysis system.

WO2005/116524 describes plant equipment which includes two gasifiers. Char from the primary gasifier is used as fuel in the secondary gasifier. The primary gasifier is a rotary kiln consisting of a rotating, slightly inclined metal shell or tube which transports fuel along its length. The exhaust gas from the secondary gasifier external to the kiln heats the tube.

WO2005/116524 further describes an apparatus and process for converting carbonaceous or other material with calorific value into high quality gas preferably to fuel a reciprocating gas engine for the generation of electricity. Wet fuel enters the unit, whereupon it is dried. The dried fuel then is checked for size via a trammel. Correctly sized fuel passes through the trammel and oversized fuel goes onto the reject conveyer where it is delivered for shredding, after which the fuel may be correctly sized. The correctly sized dry fuel is then compacted forming a cylindrical fuel plug, to minimise the amount of air, and fed via a feed system into a gasifier provided with an internal vane configuration, which allows homogenous distribution of the feed material over a large area of a retort. The gas released by the arrangement WO2005/116524 is cooled and cleaned in a gas quench unit.

One issue with many conventional ATT systems is the inability to completely crack, or break down, some materials. The syngas exiting those ATT systems therefore contains residual particulates, such as tars and oils, that must be removed from the syngas before the syngas can be used.

It is known in the art that use of a CO2 atmosphere may improve the yield of syngas produced from a pyrolysis process. "An Investigation into the Syngas Production From Municipal Solid Waste (MSW) Gasification Under Various Pressure and CO2 Concentration" (Kwon et al, presented at the 17th Annual North American Waste-to-Energy Conference 18-20 May 2009, Chantilly, Va., US, Proc 17th Annual North American Waste-to-Energy Conference NAWTEC17, paper NAWTEC17-2351) discloses that CO2 injection enables further char reduction, and produces a significantly higher proportion of CO. Additionally, CO2 injection reduces the levels of Polycyclic Aromatic Hydrocarbons (PAHs), which can be directly related to tar and coke formation during a gasification process.

The arrangement of WO2005/116524 includes a main gasifier and a secondary gasifier. The main gasifier is a rotary kiln consisting of a rotating, slightly inclined metal shell or tube which transports fuel along its length. The exhaust gas from the secondary gasifier external to the kiln heats the tube.

WO 2009/133341 relates to improvements to a gasifier. Internal vanes are attached to the rotating vessel or retort, and constructed in such a way that the feedstock falls initially onto the inner surface of the vanes nearest the longitudinal axis. The feedstock then falls through gaps between the vanes to reach outer chambers of the rotating vessel. The vanes allow homogeneous distribution of the feed material over an increased surface area of the retort whilst providing heating gas to an increased surface area extending into the retort interior.

MEANS FOR SOLVING THE PROBLEM

The inventors have devised novel and inventive Advanced Thermal Treatment apparatuses and methods. A broad description will be given of specific aspects of the invention. Preferred features of the specific aspects are set out in the dependent claims.

In accordance with the present invention, there is provided a pyrolysis method comprising applying heat from a heat source to a first region to cause a first pyrolysis process, the first pyrolysis process resulting in a gaseous mixture; applying heat from the heat source to a second region to cause a second pyrolysis process, the second pyrolysis process being applied to the gaseous mixture; wherein the second region is located closer to the heat source than the first region.

In accordance with the present invention, there is provided a gasification method comprising applying heat from a heat source to a first region to cause a first gasification process resulting in a gaseous mixture; applying heat from the heat source to a second region to cause a second gasification process to the gaseous mixture; wherein the second region is located closer to the heat source than the first region.

In accordance with the present invention, there is provided a pyrolysis apparatus comprising a first region; a second region; and a heat source being positioned such that, when operated the heat source heats the first region to cause a first pyrolysis process, the first pyrolysis process resulting in a gaseous mixture, and the heat source heats the second region to cause a second pyrolysis process, the second pyrolysis process being applied to the gaseous mixture; wherein the second region is located closer to the heat source than the first region.

In accordance with the present invention, there is provided a gasification apparatus comprising a first region; a second region; and a heat source being positioned such that, when operated the heat source heats the first region to cause a first gasification process, the first gasification process resulting in a gaseous mixture, and the heat source heats the second region to cause a second gasification process, the second gasification process being applied to the gaseous mixture; wherein the second region is located closer to the heat source than the first region.

Due to the proximity to the heat source, the second regions will be hotter than the first regions. The pyrolysis and gasification processes that occur in the second region act on a gaseous mixture that has already undergone a first ATT process. Accordingly, the hydrocarbons remaining in the gaseous mixture will be more difficult to break down, and therefore require a higher temperature. The present invention is therefore advantageous, as thermal energy in the second regions is not absorbed by hydrocarbons that are relatively easy to breakdown, and the heat is instead absorbed by hydrocarbons that are relatively difficult to breakdown, and therefore require higher temperatures to breakdown. Further, as the differing temperatures are provided by the same heat source, the invention provides a more efficient ATT apparatus and method.

Some aspects comprise applying heat from the heat source to a third region to cause a third pyrolysis process, the third pyrolysis process being applied to the gaseous mixture; wherein the third region is located closer to the heat source than the first region and the second region is located closer to the heat source than the third region. The third region may be longer than the first region and the second region. During operation of the ATT apparatus, the dwell time in the third region is longer than the dwell time in the first region and longer than the dwell time in the second region. A longer dwell time increases the chances of hydrocarbons cracking as heat is applied to the hydrocarbons for longer. This further reduces the proportion of hydrocarbons that are relatively easy to break down before the gaseous mixture enters the second, hotter, region.

Some aspect comprise applying heat from the heat source to a third region to cause a third gasification process, the third gasification process being applied to the gaseous mixture; wherein the third region is located closer to the heat source than the first region and the second region is located closer to the heat source than the third region.

In some aspects, the first region is a rotable retort and the second region is a gas enclosure, wherein the gas enclosure is located proximate the heat source.

Some aspects comprise a heating system including the heat source and a thermally insulated chamber. In some aspects, the second region is located within the thermally insulated chamber.

BRIEF DESCRIPTION OF THE DRAWINGS

Various embodiments and aspects of the present invention are described without limitation below, with reference to the accompanying figures in which.

DETAILED DESCRIPTION OF A PREFERRED EMBODIMENT

The following description relates to Advanced Thermal Treatment (ATT) of feedstock. Specific examples of ATT include pyrolysis and gasification. In the present description, 'ATT' will be used to encompass both pyrolysis and gasification. It will be understood that the description of an ATT apparatus may equally relate to a gasification apparatus or a pyrolysis apparatus. Similarly, the description of an ATT method or process may equally relate to a gasification method or process, or a pyrolysis method or process.

The present invention generally relates to multiple ATT stages using a single heating system. The preferred embodiment includes two ATT stages. A first ATT stage is used to convert feedstock into a gaseous mixture and char. A second ATT stage occurs at a significantly higher average temperature to reduce the amount of residual oils, tars and PAHs in the gaseous mixture. Each of the first and second ATT stages are heated by the same heating system. It will be appreciated that, in other embodiments, the invention is not limited to two ATT stages, and three or more ATT stages are possible.

First Preferred Embodiment

Figure 1:
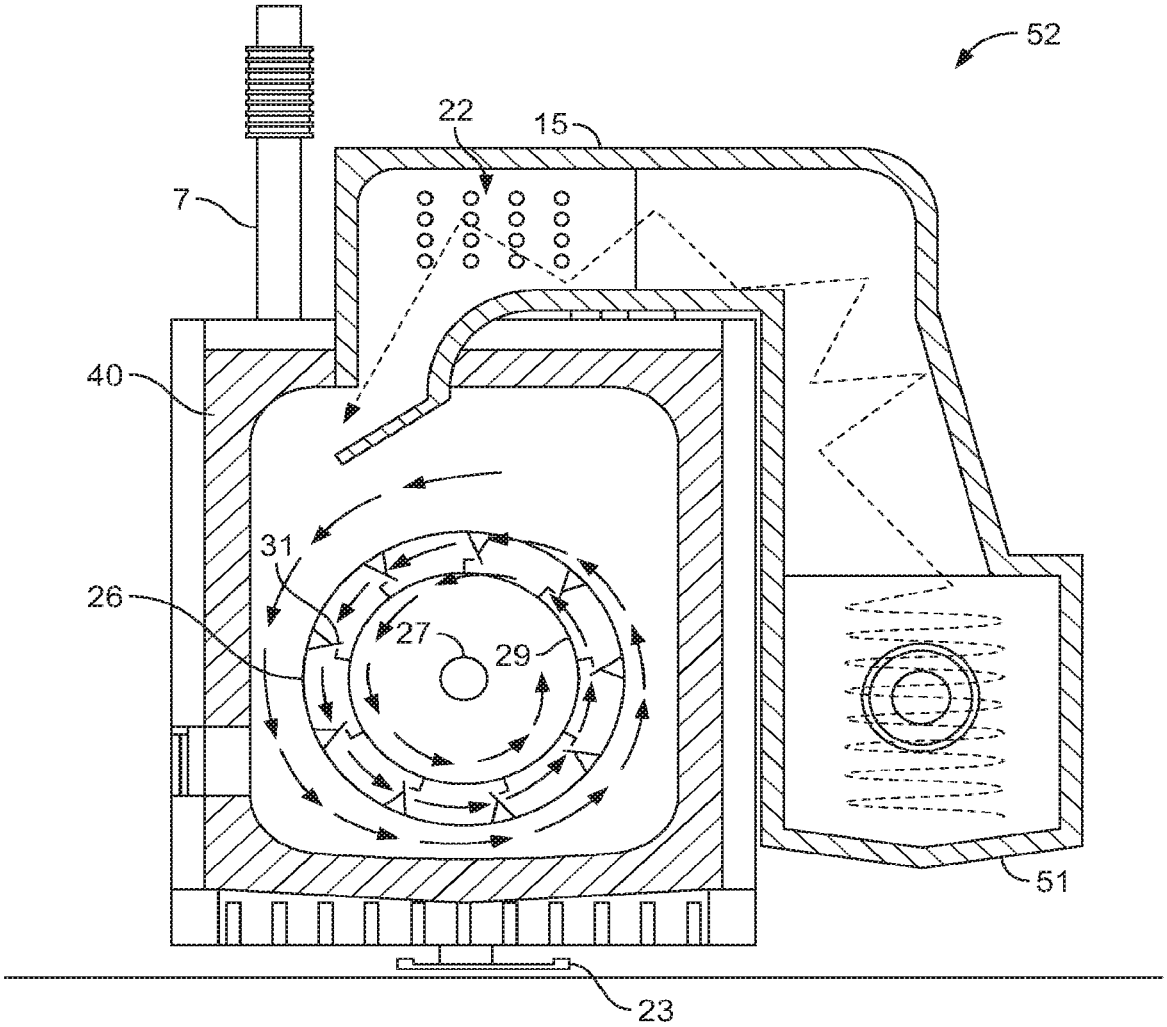
FIG. 1 is a sectional end elevation of a pyrolysis unit according to a first preferred embodiment.
Figure 2:
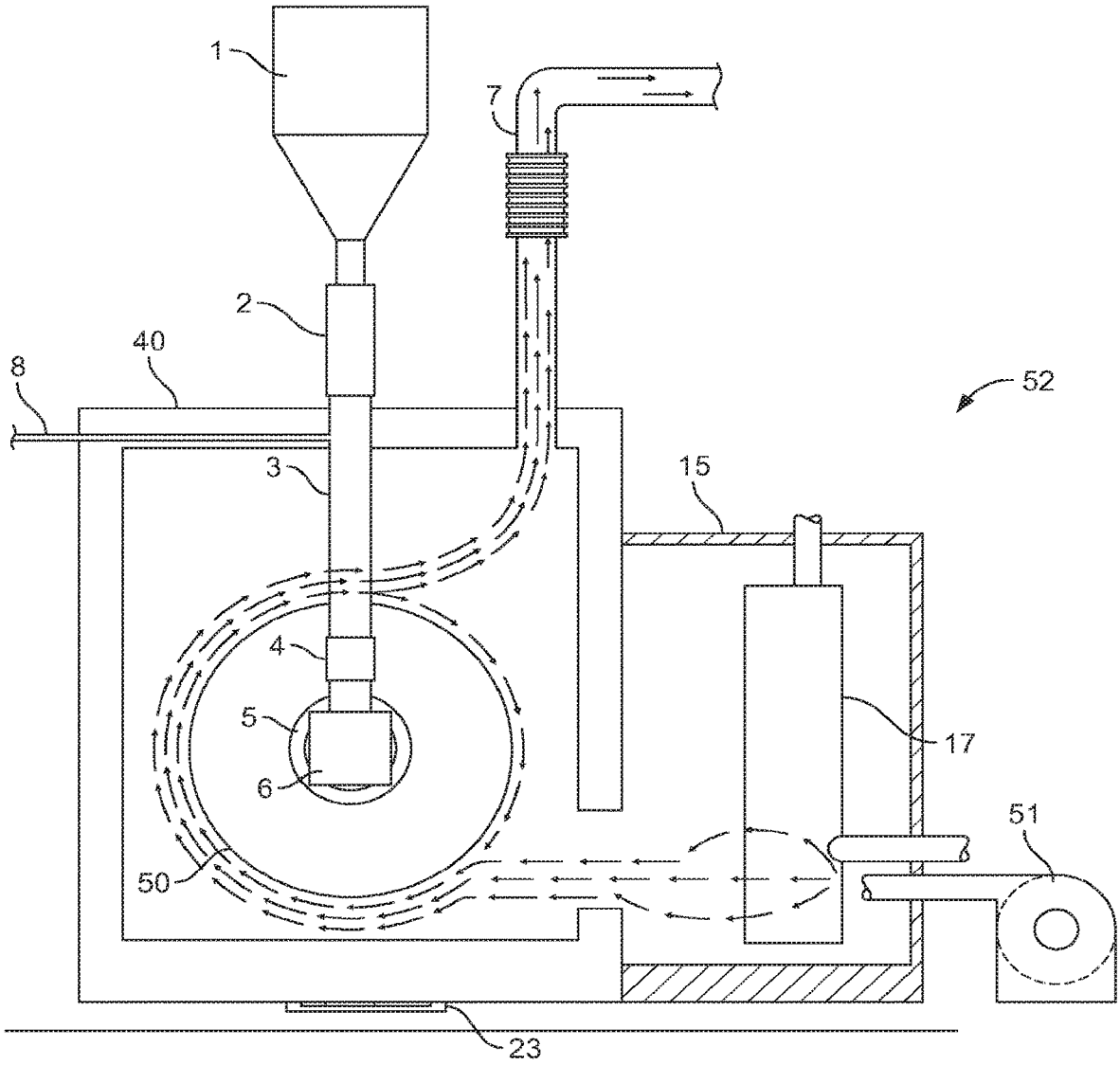
FIG. 2 is a sectional end elevation of a pyrolysis unit according to the first preferred embodiment.

Referring to FIGS. 1 and 2, an ATT apparatus comprises at least an ATT unit 50 located within a thermally insulated housing 40, and a heating system 52 for heating the interior of the thermally insulated housing 40.

The ATT unit 50 in FIGS. 1 and 2 is shown as a cylindrical retort (or 'kiln') 50, however, any ATT unit 50 having a pyrolysis or gasification region can be used. For example, in the retort 50 shown in FIGS. 1 and 2, a burner 51 directs heated air toward the surface of the retort 50, thereby creating a pyrolysis region in the retort as the temperature of the retort surface rises. As shown in FIG. 1, the first ATT unit 50 includes an inner retort 29. The inner retort 29 has holes in its surface to allow feedstock to pass from the inner retort 29 to an outer retort 26. The outer retort 26 has a larger cross-sectional diameter than the inner retort 29 thereby forming an annular cavity between the two. The inner retort 29 and the outer retort 26 are coaxial, with the inner retort 29 being located substantially within the outer retort 26 and both are substantially hollow and cylindrical in shape. The inner retort 29 may be rotated relative to the outer retort 26 by a drive motor 6. The inner retort 29 carries outward-facing vanes and the outer retort 26 carries inward-facing vanes, which act as in the above described prior art to increase the dwell time of the feedstock and char, and to mechanically break solid matter into smaller portions.

The heating system 52 comprises at least one a heat source 51 and, in some aspects, a thermally insulated chamber 15. The heating system 51 may comprises a plurality of heat sources 51. For example, in some aspects, the heating system comprises three heat sources external to a thermally insulated housing 40, and spaced along the length of an ATT unit 50.

In some aspects, the heating sources 51 are burners that emit hot air into the inside of a thermally insulated chamber 15. As shown in FIGS. 1 and 2, the thermally insulated chamber 15 has an exit aperture leading to the inside of a thermally insulated housing 40 in which the ATT unit 50 is located; with the atmosphere inside the ATT unit 50 being isolated from the atmosphere inside the thermally insulated housing 40 but external to the ATT unit 50. In other aspects, the thermally insulated chamber 15 may be omitted from the heating unit, and the heat source 51 may directly heat the inside of the thermally insulated housing 40.

The preferred heating system 52 can operate at between 1250° C. and 1600° C. Those temperatures are capable of heating the ATT unit 50 and the system of piping 28 to between 800° C. and 1000° C. (for example, 850° C., and the gas enclosure 17, 22 to between 1000° C. and 1300° C. (for example, 1200° C.). The ATT unit 50 therefore forms a first pyrolysis or gasification region. It will be appreciated that in an arrangement having more than one heat source 51, the heat sources 51 may be at different temperatures, although each heat source 51 can operate within the temperature range of 1250° C. to 1600° C.

When more than one heat source 51 is provided in the heating system 52, the heat source 51 nearest the feedstock input hopper 1 is the hottest. As the feedstock is the coldest on entry into the retort 50, the retort 50 will be coldest near the feedstock input hopper 1. Accordingly, it is advantageous to locate the hottest heat source 51 proximate the feedstock input hopper end of the retort 50 in order to minimise any potential temperature gradient along the length of the retort 50, and also to avoid inefficient use of the burners. Further, reducing the operating temperature of a heat source 51 requires less fuel. For example, the heat source 51 nearest the feedstock input hopper 1 may be at 1500° C., and the other two heat sources 51 operate at 1250° C.

The preferred embodiment includes a gas enclosure 17, 22 hermetically connected to the ATT unit 50. The gas enclosure 17, 22 is preferably located in the thermally insulated chamber 15 of the heating system 52. Preferably, the gas enclosure 17, 22 is located between the heat source (burner) 51 and an exit aperture leading to the interior of the thermally insulated housing 40 of the ATT unit 50. As the heat source 51 heats the inside of the thermally insulated housing 40, therefore, it also heats the gas enclosure 17, 22. In some aspects, the gas enclosure 17, 22 can be located proximate the heat source 51 such that the gas enclosure 17, 22 is at approximately the same temperature as the heat source 51. Hence, the gas enclosure 17, 22 can operate in a temperature range of 1250° C. to 1600° C. Accordingly, the gas enclosure 17, 22 forms a second pyrolysis or gasification region.

Figure 4:
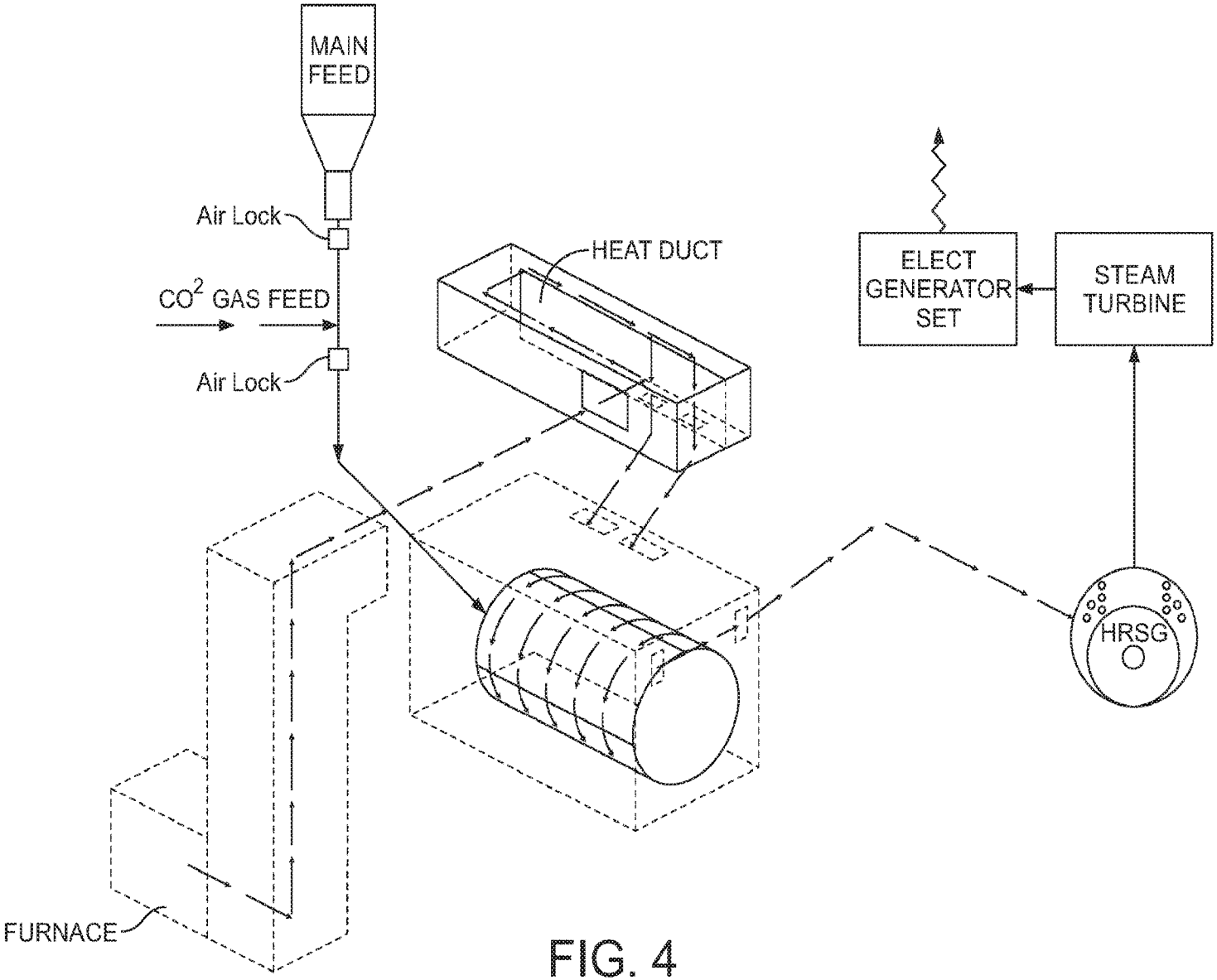
FIG. 4 is an exploded schematic isometric view of the main elements of a second embodiment.

The gas enclosure 17, 22 is connected to a syngas extraction pipe (not shown) to allow gaseous mixture to be collected once it has passed through each of the ATT stages. At this point, the gaseous mixture will include a higher percentage of syngas than a conventional ATT apparatus. If additional cleaning is required, the gaseous mixture can be fed into a wide diameter pipe, via which it passes to a second heat recovery steam generator (HRSG) 45, in which it is passed via pipes through a boiler to generate steam used to drive the steam turbine, as shown in FIG. 4. After being thus cooled, it is passed to a scrubber of conventional type which extracts impurities such as water vapour, metals, and other impurities and dust.

The scrubbed gas then passes through a hydrogen separator of conventional type which separates out hydrogen for use as a fuel for one or both of the cyclone furnaces. Finally, $CO_2$ is extracted by a $CO_2$ separator of conventional type. The extracted $CO_2$ is recycled to the air lock.

The syngas (consisting of ethane, methane, and other relatively short hydrocarbons as well as some CO) is then passed to a gasometer, and (via the gasometer or if the latter is empty, directly) to a gas turbine engine driving a second electrical generator. The engine may be a General Electric (GE) Jensbacher engine, which burns gases such as ethane and methane, without too much hydrogen content. The stored syngas not thus used to generate electricity can be sold as a fuel, and vice versa.

First ATT Stage

A first pyrolysis or gasification (ATT) process occurs at the first stage 72.

At the first ATT stage 71, feedstock is converted into a gaseous mixture and char in the ATT unit 50. The ATT unit 50 may be any pyrolysis or gasification device, such as a rotable retort or an upright static retort. In the preferred arrangement, the ATT unit 50 is a rotable retort 50. However, it will be appreciated that the rotable retort may be substituted for other ATT units.

In the first ATT stage 71, feedstock is broken down into a gaseous mixture and char. The gaseous mixture contains syngas, but will also contain residual particulates (such as oils, tars and PAHs). The gaseous mixture is then directed toward the system of piping 28. In the preferred embodiment, where the ATT unit 50 is a rotable retort 50, the gaseous mixture exits the ATT unit 50 at a gas exit aperture, which is connected to a system of piping 28. The gaseous mixture may be impelled to travel through the system of piping 28 by a booster fan 18.

The temperature inside the retort 50 depends on a number of factors, such as the material from which the retort 50 is constructed, the size (diameter and length) of the retort 50, the heat from the heating system 52, and the amount/type of feedstock. In the preferred embodiment, temperature in the retort 50 is in the range 450° C. to 750° C. More preferably, the temperature in the retort 50 is in the range 700° C. to 750° C.

Second ATT Stage

A second pyrolysis or gasification (ATT) process occurs at the second stage 73.

The second ATT stage 73 occurs within the gas enclosure 17, 22, and is at a higher temperature than either the first ATT stage 71. To achieve this, the gas vessel is located closer to the heat source than the system of piping 28 or the ATT unit 50. Preferably, the gas enclosure 17, 22 is located in the heating system 52. In aspects where a thermally insulated chamber 15 is provided, the gas enclosure 17, 22 may be located within that chamber 15. For example, the gas enclosure 17, 22 may be located between a heat source 51 and an exit aperture.

In the preferred embodiment, the gas enclosure 17, 22 is a gas conduit 22, having a diameter far less than the retort 50. In some aspects, the gas conduit has a diameter of between 5 and 10 cm (for example, 6.3 cm or 2.5 inches). As shown in FIG. 1, for example, the gas conduit 22 may be located in a thermally insulated chamber 15 and heated by the heat source 51. The gas conduit 22 is located closer to the heat source than the system of piping 28 or the ATT unit 50. Accordingly, the gas conduit 22 experiences higher temperatures from the heat source 51 than either the system of piping 28 or the ATT unit 50.

When the surface of an enclosure is externally heated, a cool region forms near the centre due to the drop off in radiative and convective heat transfer from the surface. In a cylinder, the cool region generally forms at or near the axis of the cylinder. If the same heating is applied to a cylinder with smaller diameter, the average temperature inside the smaller diameter cylinder will be greater than in a larger diameter cylinder due to that drop off in radiative and convective heat transfer.

In the gas conduit 22, however, due to the higher temperature and the smaller diameter, the average temperature within the gas conduit 22 will be higher than within either the system of piping 28 or the ATT unit 50. The temperature of the gas conduit 22 can be between 1000° C. and 1600° C., for example at 1250° C. or 1500° C.

In other embodiments, the gas enclosure may be another type of gas vessel 17 located proximate the heat source 51. As shown in FIG. 2, a gas vessel 17, which may be a box, for example, is located near a heat source 51. Such embodiments therefore utilize the high temperatures associated with the proximity of the gas vessel to the heat source 51, rather than the combination of the higher temperatures and the small diameter of a gas conduit 22.

The intended temperature for the gas enclosure 17, 22 will have an effect on the construction material. The gas enclosure 17, 22 can be made out of nickel alloy or stainless steel for most temperatures within the above ranges. However, an enclosure 17, 22 designed to operate at temperatures between 1500° C. and 1600° C. would preferably be made of titanium or an alloy thereof.

Temperature Profile

Figure 3:
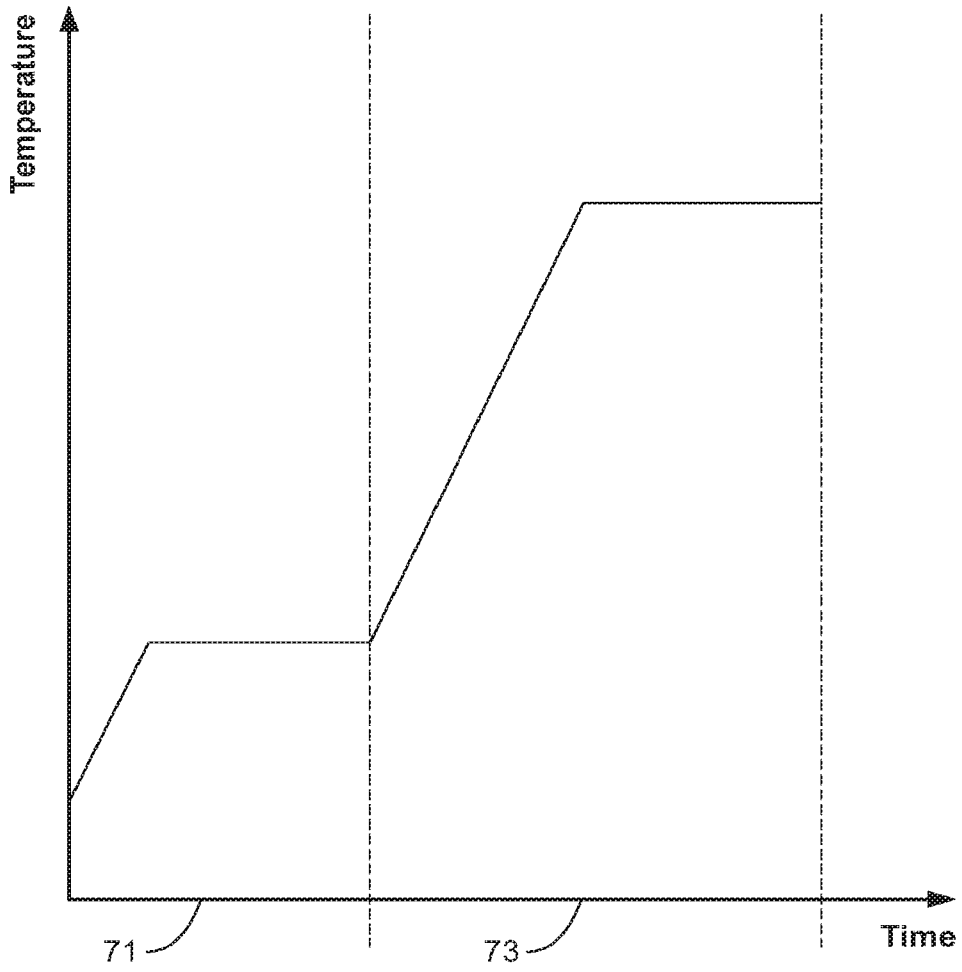
FIG. 3 is a graph showing time against temperature for carbonaceous material/gas according to the first preferred embodiment.

As described above, multiple ATT stages can be heated by a single heating system 52, with those ATT stages at different temperatures. As shown in FIG. 3, the temperature applied to feedstock/a gaseous mixture increases with each successive stage. In this regard, the first ATT stage 71 is at the lowest temperature, whereas the second (final) ATT stage 73 is at the highest temperature.

It is noteworthy that the gas path flows in the opposite direction to the heated air from a heat source 51. For example, the heated air from the heat source 51 will be hottest when it is initially emitted (i.e. at the heat source 51), and coolest when it leaves the thermally insulated housing 40 of the ATT apparatus (i.e. the heated air cools as it moves away from the heat source 51). The gaseous mixture, on the other hand, follows a gas path that is generally directed toward the heat source 51. Accordingly, the hottest ATT stage 73 is at the end of the gas path. In this way, hydrocarbons that are relatively easy to break down are not present in the gaseous mixture when the gaseous mixture is at the hottest stage (i.e. the final ATT stage). Accordingly, thermal energy in the hottest stage is not absorbed by hydrocarbons that are relatively easy to breakdown, and the heat is instead absorbed by hydrocarbons that are relatively difficult to breakdown, and therefore require higher temperatures to breakdown.

Second Preferred Embodiment

The first embodiment includes a first and a second ATT stage. The second embodiment additionally includes a third ATT stage in between the first and the second ATT stage from the first embodiment.

Figure 5:
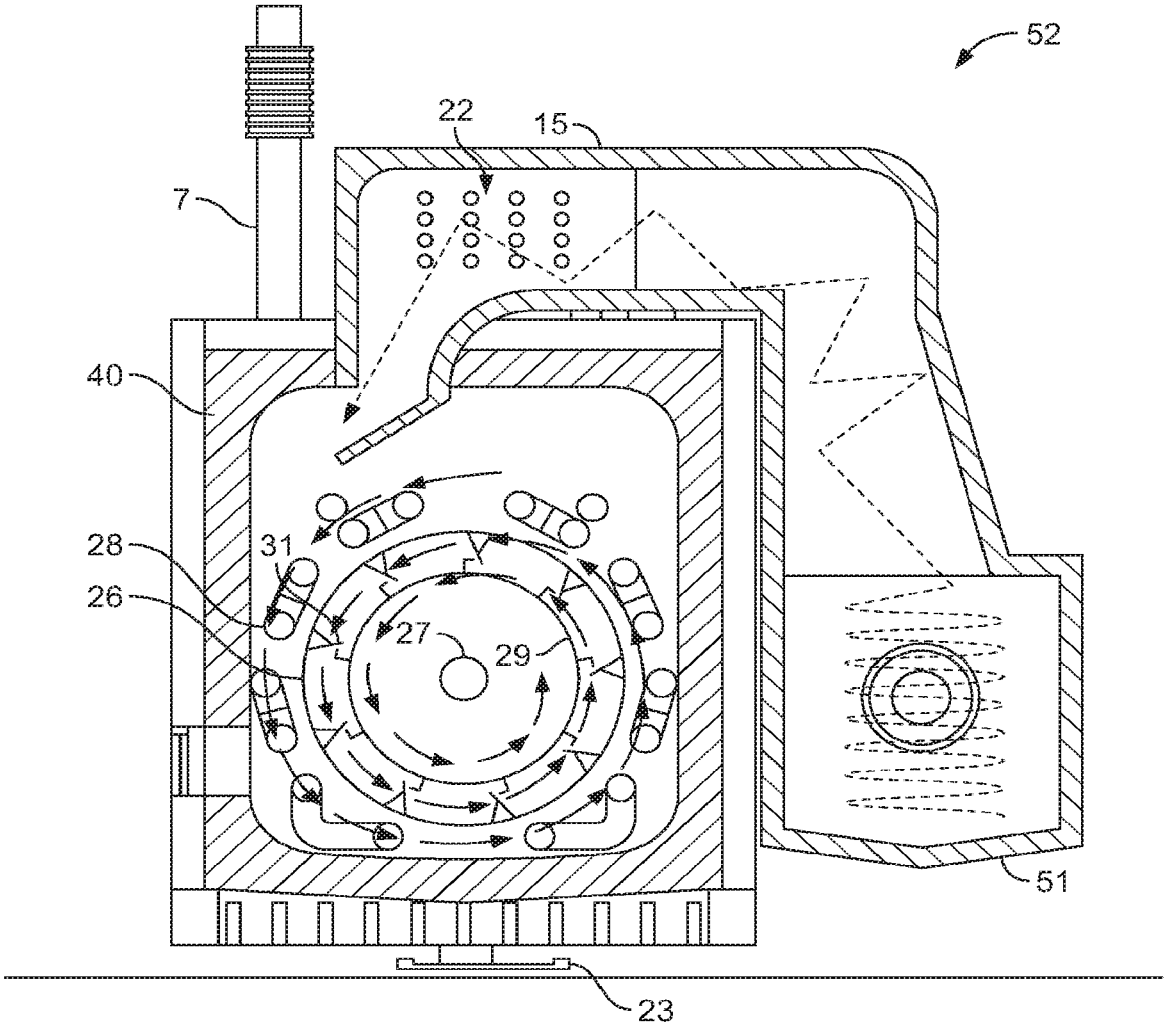
FIG. 5 is a sectional end elevation of a pyrolysis unit according to the second preferred embodiment.
Figure 6:
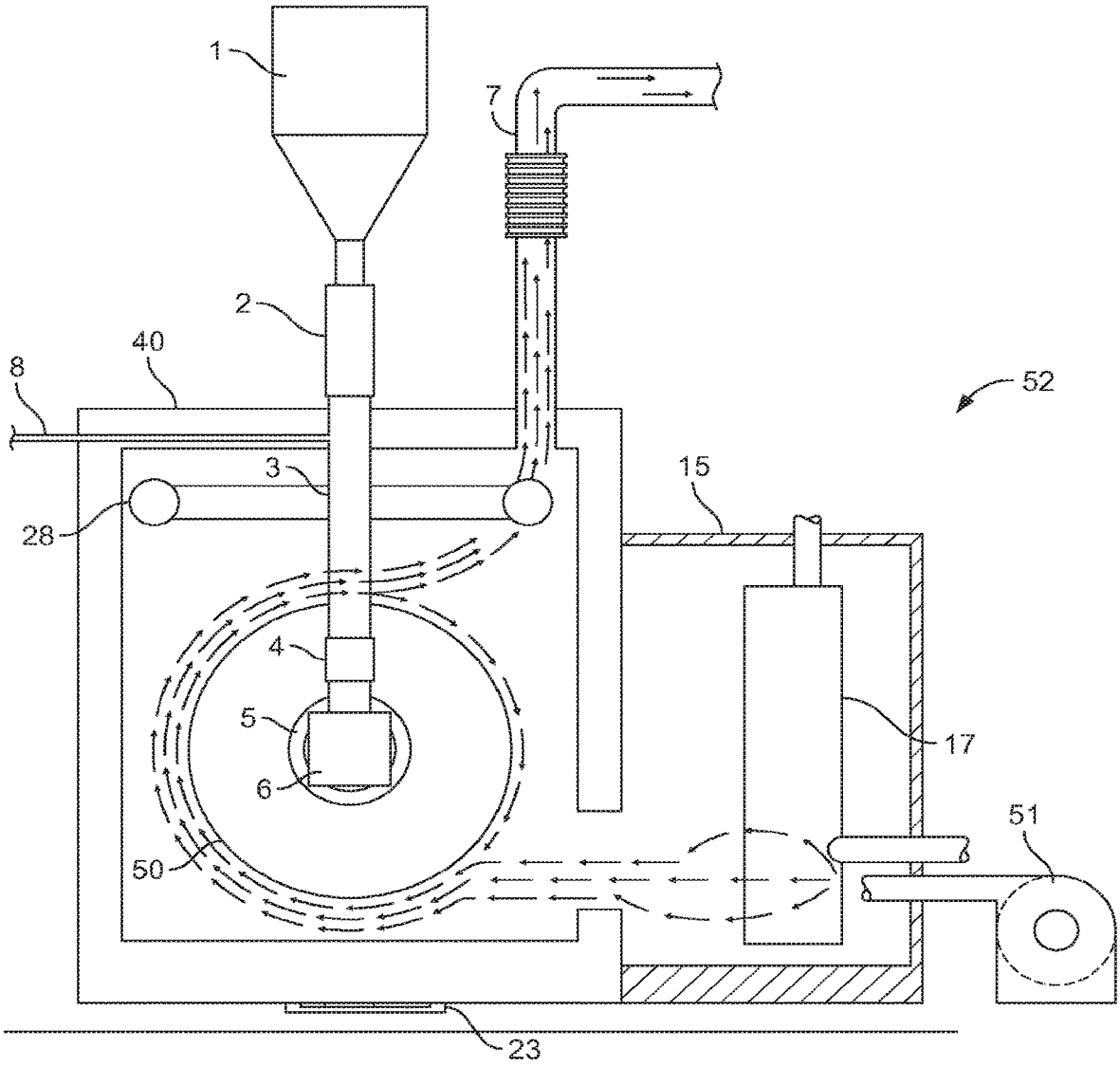
FIG. 6 is a sectional end elevation of a pyrolysis unit according to the second preferred embodiment.
Figure 8:
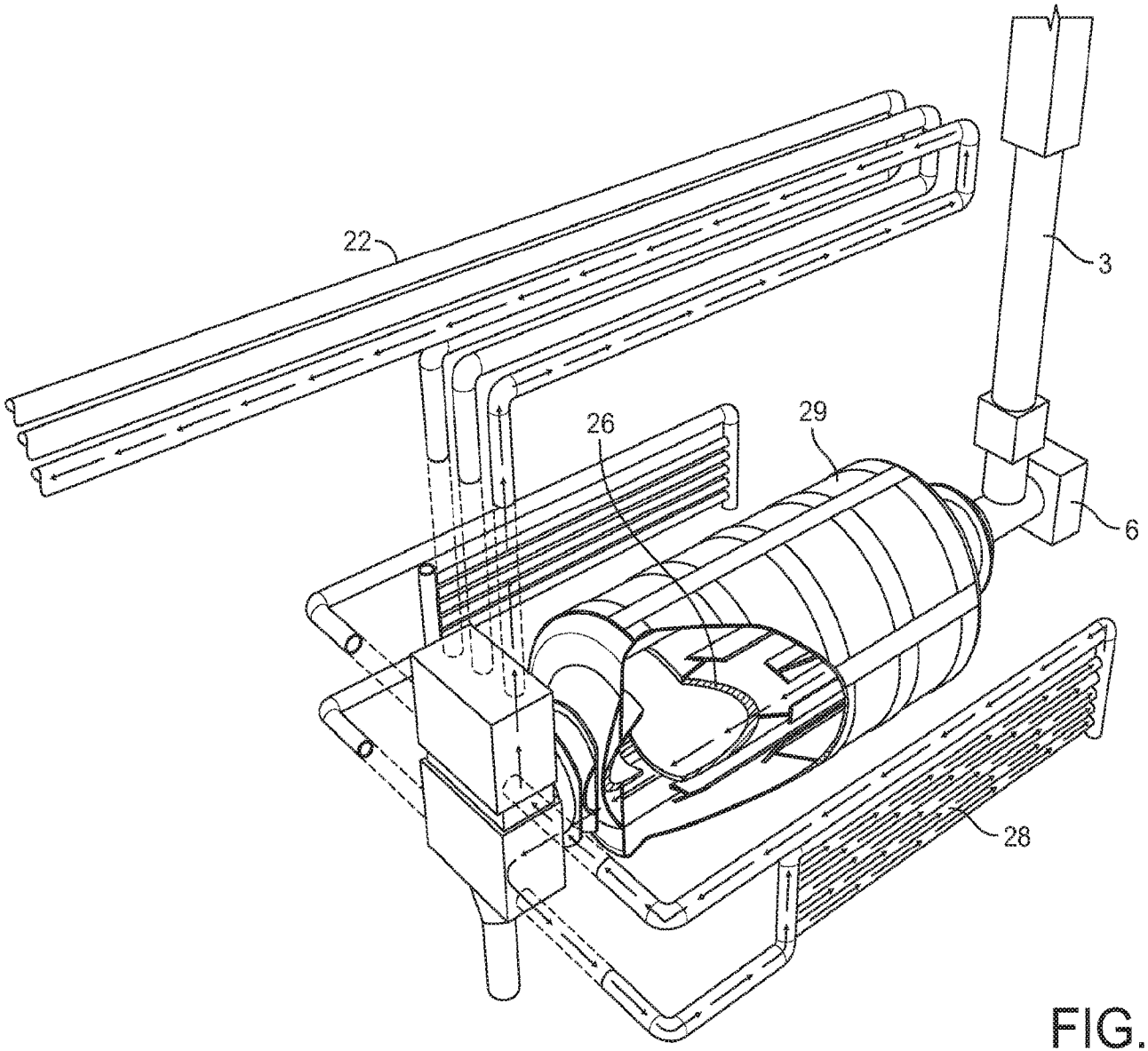
FIG. 8 is an exploded sectional perspective view of part of the second embodiment.

Referring to FIGS. 5, 6 and 8, in the second embodiment, the ATT apparatus of the first embodiment includes a system of piping 28 connected in between the gas exit aperture of the ATT unit 50 and the gas enclosure 17, 22 of the first embodiment. A gaseous mixture resulting from the first ATT process in the ATT unit 50 therefore travels along the system of piping 28 before entering the gas enclosure 17, 22.

The system of piping 28 extends along the length of the ATT unit 50 and comprises a plurality of straight lengths with curved connecting portions in between. Each of the straight lengths is positioned parallel, or substantially parallel, with the axis of the ATT unit 50. Thus, the total length of the system of piping 28, including each of the straight portions and the curved connecting portions, is many times the length of the ATT unit 50. The dwell time for a gaseous mixture within the system of piping 28 is therefore longer than the dwell time inside the ATT unit 50.

The system of piping 28 is located within the thermally insulated housing 40 along with the ATT unit 50. As shown in FIGS. 5 and 6, both the rotable retort 50 and the system of piping 28 are heated by the same heating system 52. The temperature applied to the rotable retort 50 and the system of piping 28 will therefore be approximately the same.

When the ATT unit 50 is a rotable retort, the diameter of the system of piping 28 will be smaller than the diameter of the retort 50. In some aspects the system of piping 28 has a diameter of 10 cm, whereas a retort 50 may have a diameter of between 1.4 m and 2 m. Due to the smaller diameter, the average temperature in the system of piping 28 will therefore be greater than the average temperature in the retort 50. Accordingly, the system of piping 28 forms a third ATT region, in which a third ATT process occurs on a gaseous mixture resulting from the first ATT process in the ATT unit 50.

In some aspects, as shown in FIG. 5, the system of piping 28 is at least in part closer to the heat source 51 than the rotable retort 50. Having the system of piping 28 surrounding the retort 50, as shown in FIG. 5, allows the system of piping 28 to be heated by the hot air from the heat source 51 as that hot air circulates around the retort 50 inside the thermally insulated housing 40.

In other aspects, the entirety of the system of piping 28 is closer to the heat source 51 than the rotable retort 50, thereby placing the system of piping 28 at a higher temperature than the rotable retort 50.

In some aspects, as shown in FIG. 6, the system of piping 28 is further from the heat source 51 than the rotable retort 50. This can make manufacturing and maintenance simpler by making the system of piping 28 more accessible.

Third ATT Stage

A third pyrolysis or gasification (ATT) process occurs at the third stage 72.

The third ATT stage 72 occurs in a system of piping 28, which has a smaller diameter than the rotable retort (ATT unit). For example, the system of piping 28 in some aspects has a diameter of 10 cm, whereas a retort 50 may have a diameter of between 1.4 m and 2 m.

As the system of piping 28 and the ATT unit 50 are heated externally, the interior of those vessels is heated by convection and radiation from a heated wall of the respective vessel. Hence, the temperature inside the system of piping 28 and the ATT unit 50 has an inverse relationship with the distance from the respective vessel's walls.

In the preferred embodiment, both the rotable retort 50 and the system of piping 28 are heated by the same heating system 52. The temperature applied to the rotable retort 50 and the system of piping 28 will therefore be approximately the same. As the system of piping 28 has a smaller diameter than the rotable retort (ATT unit) 50, however, the temperature at the centre of the system of piping 28 is greater than the temperature at the centre of the ATT unit 50, and the average temperature of the third ATT stage 72 is greater than the average temperature of the first ATT stage 71, but less than the average temperature of the second ATT stage 73. This can be seen in FIGS. 5 and 6.

Preferably, the system of piping 28 has a cross-sectional diameter much smaller than the retort structure, for example four inches (approximately 10 cm). The system of piping 28, in some aspects, is made out of nickel alloy, although other materials, such as stainless steel and titanium can be used depending on circumstances.

More advantageously, the system of piping 28 in the preferred aspect is many times the length of the ATT unit, and so the dwell time of the gaseous mixture is increased, as seen in FIGS. 5 and 8. Accordingly, the longer-chain hydrocarbons (associated with tar and oil retention) and/or other residual particulates in the gaseous mixture are more likely to be broken down.

Subsequent to the third ATT stage 72, the gaseous mixture is directed toward a gas enclosure 17, 22 located proximate or within the heating system 52. In the preferred arrangement, the end of the system of piping 28 that is not attached to the gas exit aperture is connected to the gas enclosure 17, 22, which is within the heating system 52.

The temperature within the system of piping 28 will depend on, for example, the diameter of the system of piping 28, the heat supplied from the heating system 52, and the temperature of the gaseous mixture from the ATT unit 50. It is envisaged, however, that the temperature within the system of piping 28 is in the range 700° C. to 1000° C. Preferably, the temperature within the system of piping 28 is in the range 850° C. to 1000° C.

Temperature Profile

Figure 7:
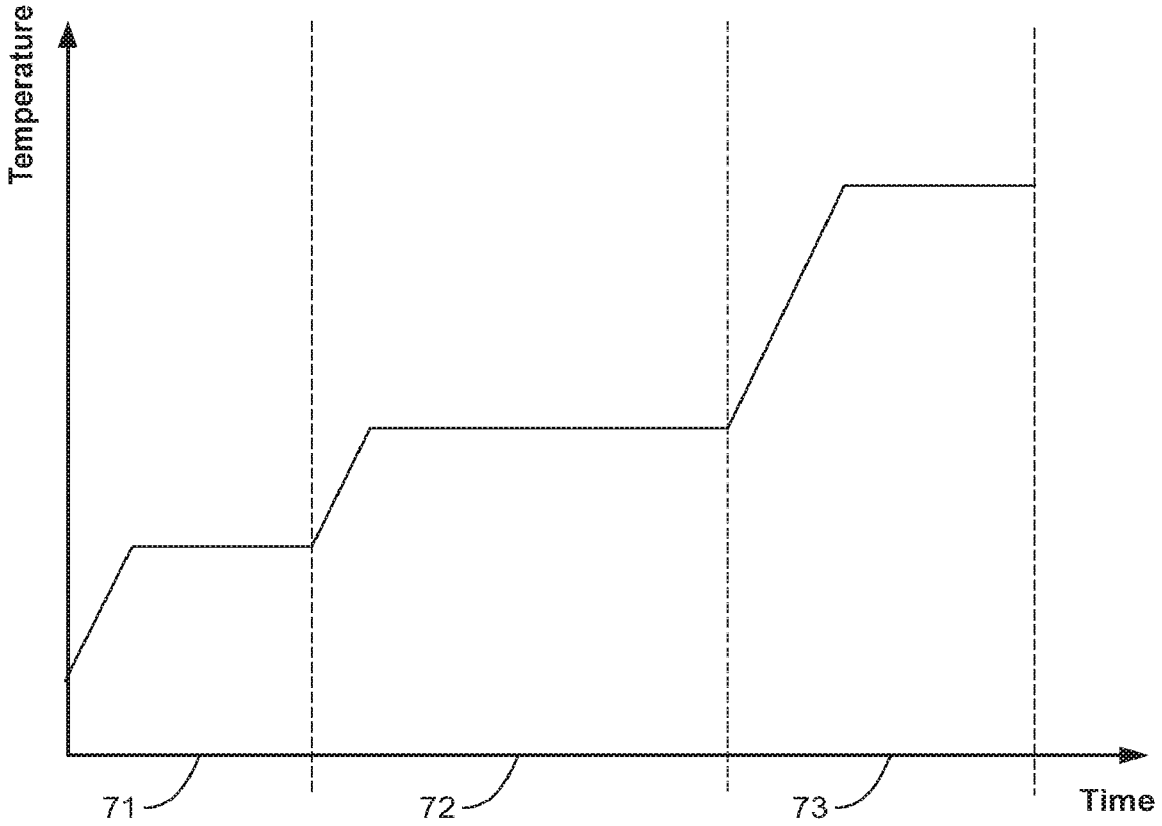
FIG. 7 is a graph showing time against temperature for carbonaceous material/gas according to the second preferred embodiment.

Referring to FIG. 7, the temperature profile of the second embodiment includes an additional step to account for the third ATT stage 72. The third stage 72 is preferably longer than the first and second stages, thereby providing a longer dwell.

Other Aspects, Embodiments and Modifications

It will be appreciated that a more efficient ATT method and apparatus can be achieved without each of the ATT stages mentioned in the preferred embodiment. For example, the gaseous mixture may be directed from the ATT unit 50 to the gas enclosure 17,22 without first entering a system of piping 28, thereby omitting the second ATT stage. The ATT apparatus will still, however, apply the first ATT process and the, hotter, third ATT process using the same heating system. Accordingly, a greater proportion of hydrocarbons will be broken down in comparison to a conventional system where simply a gasification or pyrolysis apparatus is heated by a heating system.

In the preceding embodiments, a cylindrical rotating retort has been described. However, in other embodiments, different shapes could be adopted. For example, the cross-section does not need to be constant along the entire length of the retort—it could flare or narrow downwards.

Likewise, whilst a circular cross-section is convenient to manufacture, non-circular cross-sections could be used; an elliptical cross-section increases the dwell time on some parts of the retort which may be useful in some cases. Many other cross-sections could be used, though sharp corners might tend to trap material. The rotation employed might likewise be provided using elliptical gears or other means to vary the rotational speed within each rotation, so as to control the dwell time on different sectors of the retort.

Whilst rotation, unidirectional or bidirectional, has been described, it would be possible to turn the retort through less than an entire turn before reversing it—in other words, to apply a rotational oscillation. In this case, the retort does not need to be enclosed but could be a concave, for example semicircular, surface.

Other aspects which might be used with the present invention are described in our co-pending applications incorporated in their entirety by reference, filed the same day as the priority application for the present application, GB1503772.4, and with the following titles and application numbers:

GB1503766.6 "Pyrolysis Methods and Apparatus"

GB1503760.9 "Pyrolysis or Gasification Apparatus and Method"

GB1503765.8 "Pyrolysis Retort Methods and Apparatus"

GB1503770.8 "Advanced Thermal Treatment Apparatus"

GB1503769.0 "Advanced Thermal Treatment Methods and Apparatus"

A person skilled in the art would understand that various types of heat source and fuels therefor could be used, in addition to those described above and in the co-pending applications mentioned above.

Many other variants and embodiments will be apparent to the skilled reader, all of which are intended to fall within the scope of the invention whether or not covered by the claims as filed. Protection is sought for any and all novel subject matter and combinations thereof disclosed herein.

The invention claimed is:

1. An advanced thermal treatment (ATT) apparatus comprising:

a first advanced thermal treatment (ATT) region, wherein the first ATT region comprises a cylindrical retort;

a second ATT region, wherein the second ATT region comprises a gas enclosure;

a third ATT region located in between the first region and the second region, wherein the third ATT region is a system of piping; and a heat source being positioned such that, when operated the heat source heats the first region to cause a first ATT process, the first ATT process resulting in a gaseous mixture, and the heat source heats the second region to cause a second ATT process, the second ATT process being applied to the gaseous mixture, and the heat source is further adapted to heat the third region to cause a third ATT process, the third ATT process being applied to the gaseous mixture; and wherein the second ATT region is located closer to the heat source than the first region.

2. The apparatus of claim 1, wherein a diameter of the second ATT region is smaller than the diameter of the first ATT region.

3. The apparatus of claim 1, wherein the third ATT region is longer than the first ATT region and longer than the second ATT region, such that, during operation, a dwell time in the third ATT region is longer than a dwell time in the first ATT region and longer than a dwell time in the second ATT region.

4. The apparatus of claim 1, wherein the gas enclosure is located proximate the heat source.

5. The apparatus of claim 1, further comprising a heating system including the heat source and a thermally insulated chamber.

6. The apparatus of claim 5, wherein the second region is located within the thermally insulated chamber.

7. The apparatus of claim 1, wherein the first and second ATT processes each comprise a pyrolysis process.

8. The apparatus of claim 1, wherein the first and second ATT processes each comprise a gasification process.

* * * * *